United States Patent [19]

Moretti

[11] Patent Number: 4,494,040

[45] Date of Patent: Jan. 15, 1985

[54] RADIO FREQUENCY QUADRUPOLE RESONATOR FOR LINEAR ACCELERATOR

[75] Inventor: Alfred Moretti, Downers Grove, Ill.

[73] Assignee: The United States of America as represented by the United States Department of Energy, Washington, D.C.

[21] Appl. No.: 435,181

[22] Filed: Oct. 19, 1982

[51] Int. Cl.[3] ..... H01J 25/10

[52] U.S. Cl. ..... 315/5.41; 315/3; 315/5.42; 313/361.1; 328/233

[58] Field of Search ..... 315/5.41, 5.42, 3; 328/233; 313/361.1, 360.1

[56] References Cited

U.S. PATENT DOCUMENTS

| | | | |
|---|---|---|---|
| 2,904,720 | 9/1959 | Bell | 315/5.42 |
| 3,147,445 | 9/1964 | Wuerker et al. | 315/3 X |
| 3,252,104 | 5/1966 | Gordon | 315/3 X |
| 3,304,461 | 2/1967 | Prine | 315/3 |
| 4,181,894 | 1/1980 | Pottier | 328/233 |
| 4,350,927 | 9/1982 | Maschke | 315/5.41 |
| 4,360,760 | 11/1982 | Brodowski | 315/5.41 |
| 4,404,495 | 9/1983 | Müller | 315/5.41 |

*Primary Examiner*—Saxfield Chatmon

*Attorney, Agent, or Firm*—William Lohff; Robert J. Fisher

[57] ABSTRACT

An RFQ resonator for a linear accelerator having a reduced level of interfering modes and producing a quadrupole mode for focusing, bunching and accelerating beams of heavy charged particles, with the construction being characterized by four elongated resonating rods within a cylinder with the rods being alternately shorted and open electrically to the shell at common ends of the rods to provide an LC parallel resonant circuit when activated by a magnetic field transverse to the longitudinal axis.

7 Claims, 8 Drawing Figures

RADIO FREQUENCY QUADRUPOLE RESONATOR FOR LINEAR ACCELERATOR

CONTRACTUAL ORIGIN OF THE INVENTION

The United States Government has rights in this invention pursuant to Contract No. W-31-109-ENG-38 between the U.S. Department of Energy and the University of Chicago representing Argonne National Laboratory.

BACKGROUND OF THE INVENTION

This invention relates to linear accelerators (linacs) and more particularly to accelerators with radio frequency quadrupole (RFQ) resonators for controlling the acceleration, focusing and other characteristics of a beam of high velocity charged particles.

An RFQ linac is a structure which has four-pole symmetry and produces focusing, bunching, and acceleration of charged particle beams by the use of radio frequency fields only. No static internal magnetic or electric fields are required as is the case in a conventional RF linac. The four-pole symmetry of the device produces a strong electric quadrupole field in the vicinity of the axis, which can be used to focus and confine charged particle beams. By modulating the pole piece tips as generally described in "RF Quadrupole Beam Dynamics", by R. H. Stokes, K. R. Crandall, J. E. Stovall, and D. A. Swenson, IEEE Transactions on Nuclear Science, Vol. NS-26, No. 3, June 1979, a longitudinal component of electric field is produced, which can be used to bunch and acelerate the beam. The modulation on the pole piece tips also produces strong alternating gradient focusing of the beam. Thus, the RFQ is capable of focusing, bunching and accelerating charged-particle beams to high energy.

Since the RFQ linac uses electric fields for focusing, it has stronger focusing power for low velocity particles than the conventional magnetic quadrupole, and therefore lower injection energy is required than with a conventional linac. In addition it can be designed to adiabatically bunch the beam producing near-perfect beam capture.

The basic components of an accelerator (as illustrated in FIG. 1) include a source of "low" velocity electrically-charged particles, external focusing magnets, one or more RFQ resonators in which the particles are bunched, focused and accelerated, control magnets and a target or experimental chamber. For the RFQ resonator, the control operations are accomplished by means of a radio frequency electric field. The modulations between adjacent electrodes or rods are spaced a distance apart equal to the distance a particle would travel in half of a radio frequency period. Thus the particle travels to the next set of modulation in correct radio frequency phase to gain energy from the electric field and also, receive alternating-gradient transverse electrical focusing forces. As the particle gains energy, it is also required that the spacing between modulation of the rod be increased so that the particle stays in synchronism with the periodic changing electric field.

RFQ resonators are often designed with a long cylindrical cavity whose axis is the same as the axis of the accelerated beam. In one design, as illustrated in FIGS. 2 and 3, four vanes are equally spaced at the inner wall of the chamber or cavity and extend along the length of the cavity. These vanes are fixed to the inner chamber wall and taper inwardly towards the center of the cavity. The vane tips are modulated in order to form and shape the electric field to provide the desired bunching, focusing and acceleration of the particles. The electric fields between the tips of adjacent vanes are as illustrated in FIG. 3. The radio frequency quadrupole mode, i.e., that which is required for proper operation, is essentially the perturbed $TE_{210}$ cylindrical resonant cavity mode excited at the cut-off frequency by proper end termination, essentially an "open circuit".

One of the problems associated with this design relates to the existence of a plurality of resonant frequencies which may occur in addition to the desired frequency of the quadrupole mode. These include resonances such as $TE_{11N}$ and $TM_{01N}$ which naturally occur lower or higher in frequency than $TE_{210}$ depending on the value of N. However, they are brought near the desired $TE_{210}$ resonant frequency because of perturbing effects of the vanes. In addition, higher order $TE_{21N}$ modes are also possible. In all the above, N is the number of half wavelength variations in the axial direction. With these other resonant frequencies near that of $TE_{210}$; adjustment, control, stability and operation of the resonator become difficult because the other resonant frequencies interfere with proper excitation of the desired $TE_{210}$ mode. Any mechanical changes with time or temperature cause these interfering resonances to change with respect to each other and the desired $TE_{210}$ mode.

In another design as illustrated in FIGS. 4 and 5, the modulated electrodes or rod elements are located close to the central axis. In this design, adjacent rods are shorted to different sections of the outer shell and the rod ends make no contact with the cavity axial ends. The shorting elements (67 and 68) form the inductance "L" of the circuit with the spacing between adjacent rods forming the capacitance, "C". The circuit is resonant as a parallel LC circuit. The magnetic field lines are characterized by longitudinal paths concentrated near the inside of the shell parallel to the axis. The magnetic lines loop around at the cavity ends down the other side and around again. This design also has interfering modes much as the previous design close to the desired quadrupole mode when the structure is made longer for higher energy output.

One object of the invention is an RFQ resonator with fewer interfering modes. A second object of the invention is an RFQ resonator for a linear accelerator. A third object of the invention is an RFQ resonator which may be of reasonable size while providing the desired focusing, bunching and accelerating of the particles and especially heavy ions. A further object of the invention is an RFQ resonator which may be extended in length and include multiple resonating units without inducing any interfering mode. Additional objects, advantages and novel features of the invention will be set forth in part in the description which follows, and in part will become apparent to those skilled in the art upon examination of the following or may be learned by the practice of the invention.

SUMMARY OF THE INVENTION

Briefly, the invention is directed to an RFQ resonator or RFQ resonators for a linear accelerator which resonate on a one-quarter wavelength principle and include internal elements arranged to form an internal LC resonant circuit to provide a low resonant frequency useful for accelerating heavy particles. With this circuit, any interfering modes are reduced in amplitude so that the resonator is essentially free from interfering modes. The resonator comprises a metallic elongated chamber, cavity or hollow cylinder with a central longitudinal axis and a plurality and preferably four elongated modulated elements or rods centrally disposed about the axis in an arrangement in which adjacent elements have common end sections respectively shorted and open electrically at one end of the cylinder. The second set of common end sections have the reverse pattern so that each element is shorted at one end section and open at the second end section. In this arrangement, the elements can be viewed as strip lines shorted at one end. They resonate at a frequency lower than the quarter-wavelength resonant frequency of a strip line shorted at one end because of the large capacitive loading between adjacent elements. Means are provided to create magnetic field lines which are concentrated and circle around the inside circumference of the chamber so that the inductance "L" is measured along the length of the element. The magnetic field lines are exactly 90 degrees to the field lines of the other two prior designs.

With this arrangement, the operation of the resonator in the quarter wavelength mode permits a smaller diameter unit to be constructed than the resonator of FIGS. 3 or 5 because the inductance is proportional to the length. In the two prior designs, the inductance is proportional to the diameter and there is little advantage based on length, since the RFQ linac has to be long to accelerate particles to high energy.

DETAILED DESCRIPTION OF THE PREFERRED EMBODIMENT

Figure 1:
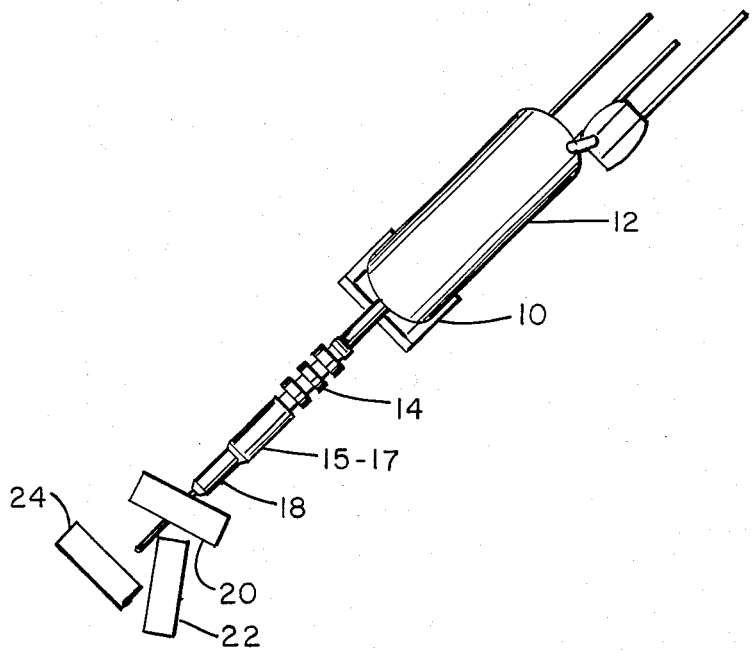
FIG. 1 is a top view of the primary units of a linear accelerator.
Figure 2:
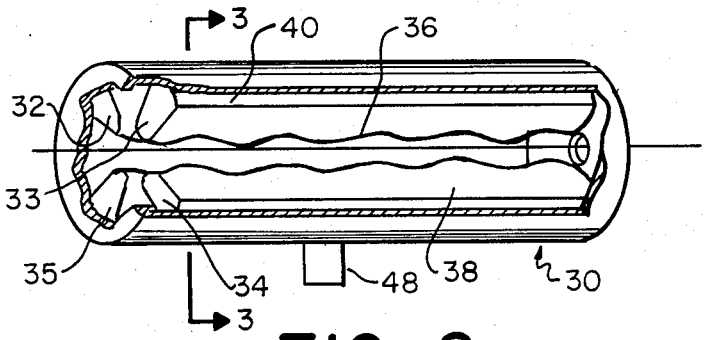
FIG. 2 is a side view with a partially cut-away view of a RFQ resonator of a prior design.
Figure 3:
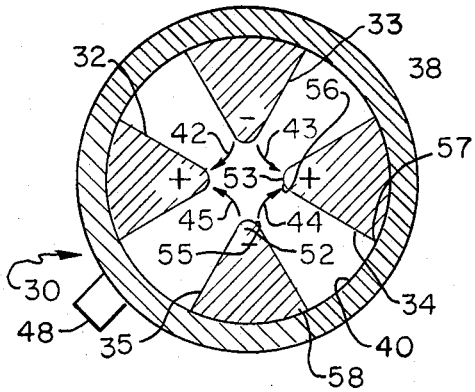
FIG. 3 is an end sectional view of the RFQ resonator of FIG. 2 taken along line 3—3'.

As illustrated in FIG. 1, a linear accelerator 10 includes a source of charged particles 12; focusing magnets 14, a plurality of RFQ resonators 15–17 in which the particles are bunched, focused and accelerated; focusing magnets 18, control (bending) magnet 20 and target chambers 22 and 24. FIGS. 2 and 3 provide an illustration of an RFQ resonator 30 of a prior design with four vanes 32–35 tapering inwardly from inner wall 40 of chamber 38. Lines of force 42–45 illustrate the electrical fields between vanes 32–35 generated by a power source 48 which establishes a changing magnetic field inside the cavity. The changing magnetic field lines enclosed within path 55–58, act to induce a voltage by Lenz's law between vane tips 52 and 53. A voltage appears along the length of the vanes. The magnetic field lines are directed parallel to the chamber axis and are concentrated near the inside shell surface 40 in the space between the vanes. They loop around at the ends. In a similar manner, voltages are induced between other pairs of the vane tips.

Figure 5:
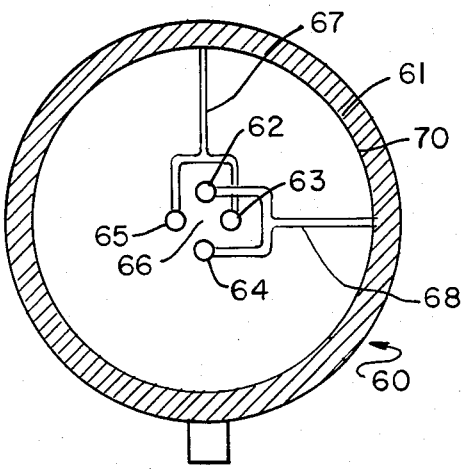
FIG. 5 is an end sectional view of the RFQ resonator of FIG. 4 taken along line 5—5'.
Figure 4:
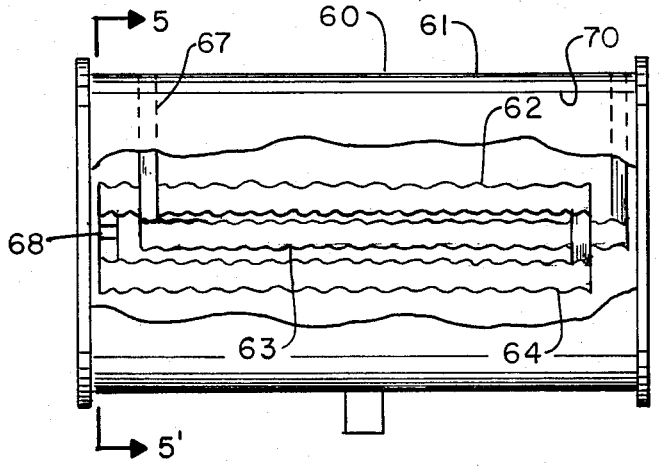
FIG. 4 is a side view with a partially cut-away view of an RFQ resonator of a second prior design.

In the RFQ resonator 60 of a second prior design illustrated in FIGS. 4 and 5, four rod-like elements 62–65 are disposed about the central axis 66. Shorting forks 67–68 are mounted on the inner wall 70 of cylinder 61 and provide support and electrical shorting for the elements. In this arrangement, each of the elements is shorted near each end section of the cylinder. The RFQ resonator 60 resonates as a parallel LC resonant circuit. The inductance L is provided by the shorting forks 67–68. The capacitance between adjacent rods 62–65 provides the C.

Figure 6:
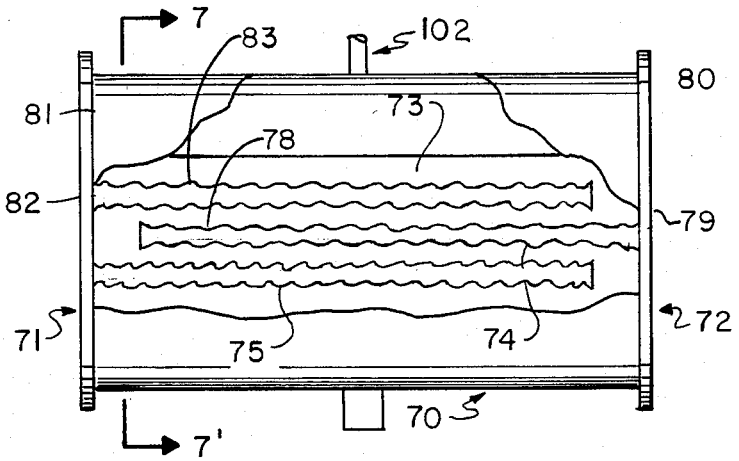
FIG. 6 is a side view with a partially cut-away view of an RFQ resonator illustrative of one embodiment of this invention.
Figure 7:
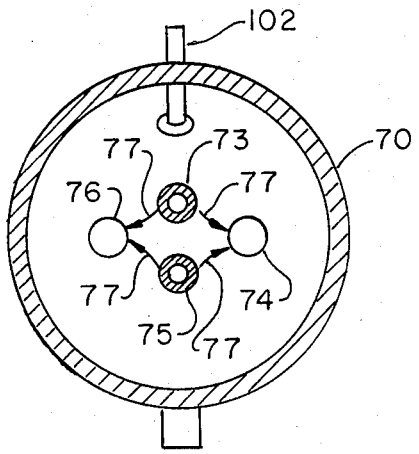
FIG. 7 is an end sectional view of the RFQ resonator of FIG. 6 taken along line 7—7'.

In the RFQ resonator of the invention as illustrated in FIGS. 6 and 7, four rods 73–76 provide a natural resonant frequency in the quadrupole mode with end sections of rods 73 and 75 shorted at end 71 of resonator 70 and separated from end 72. End sections of rods 74 and 76 have the reverse connection being shorted at end 72 and separated from end 71. Electrical fields as illustrated by field 77 are generated between the rods to provide the required quadrupole symmetry. Electrical field lines 77 illustrates the field pattern.

With the arrangement of rods 73–76 provided by the invention, the rods essentially act as a quarter-wave strip line resonator to provide the inductance with the spacing between the rods providing the capacitance of a parallel LC resonant circuit. Because of the large capacitive loading between adjacent rods, they resonate at a frequency much lower than the quarter-wavelength resonance of a strip line shorted at one end. In addition, there are no nearby resonances to interfere with the quadrupole mode. The frequency of the quadrupole mode is also the first resonant frequency of the device and occurs at the lowest frequency. The diameter of the cavity is small for low rf frequencies which is important for the acceleration of the heavy ion particles. Further the resonator is easily tuned to frequency by the movement of the tuning ball 102. Thus tuning can be easily accomplished to correct for any frequency change which may occur with time or temperature. The other prior design cannot accomplish this feature so easily because of the many nearby interfering modes.

The size of the resonator of this invention can be determined by the ratio of the capacitance, $C_{12}$, between adjacent rods and the capacitance, $C_{11}$ between one rod and all other rods and ground; and is given by the following equation:

$$\cos^{-1}\left(\frac{2\pi l}{\lambda}\right) = \frac{2C_{12}}{C_{11}}$$

where l is the length of the resonator and λ is the wavelength of the wave. The above capacitances can best or most easily be determined by the use of the computer program "POISSON" available from the Argonne National Laboratory of Argonne, Ill.

Further with regard to FIGS. 6 and 7 and the magnetic and electrical fields associated with RFQ resonator 70, a changing magnetic field extending around and concentrated near the inside of the shell transverse to the longitudinal axis, is enclosed by path 78–83 and acts to induce a voltage across rod sections 78 and 83 and along the length of the rods as determined by Lenz's law. By this magnetic field, the effective inductance is measured along the axial length of the rods. In a similar manner, magnetic fluxes in other loops provide voltages between other pairs of the rods. Accordingly, the desired voltage pattern similar to that in FIG. 3 is provided in FIG. 7 at the quadrupole mode. Power is provided to the resonators of FIGS. 5 and 7 in a similar manner to the arrangement in FIG. 3. RF power is provided and coupled to the resonator of FIG. 7 by, for example, a loop to generate a magnetic field transverse to the axis.

Rods 73–76 may be solid or hollow and constructed of aluminum, copper or a copper clad steel with copper or aluminum forming the outer surfaces. Shell 84 is also constructed of aluminum, copper or copper clad steel with copper or aluminum forming the inner surfaces.

Representative values for a typical wavelength of 10 meters are a diameter for the rods of 1/50–1/300 of the wavelength, a diameter of the cylinder of about 1/5–1/30 of the wavelength, and a length for the rods of about two meters with about 1–2 cm separating the free ends of the rods from the adjacent end of the cylinder. Accordingly, the RFQ resonator 70 with these dimensions is of a reasonably small size compared to some designs.

Figure 8:
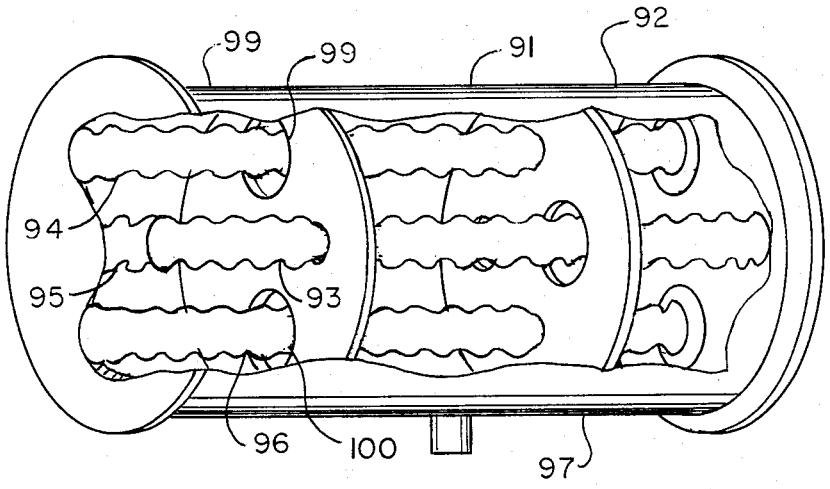
FIG. 8 is a side sectional view of multiple resonators of the invention.

FIG. 8 provides an illustration of multiple resonators 90–92 with rod elements 93–96 extending along the combined length 97. As illustrated, the open circuits are provided by rod sections within openings 99 and 100 of plate 98. By this arrangement, resonators may be constructed of varying lengths and numbers of individual units. This arrangement is further characterized by magnetic paths extending around the circumference of the shell in a direction transverse to the longitudinal axis. In addition, the area of the magnetic path is greater than the area of design in FIG. 4 and therefore permits the use of a reasonably small shell or cylinder in the construction of the resonator in FIG. 8 as well as that in FIG. 6.

As illustrated in FIG. 1, one or more resonators may be used to provide the desired acceleration, focusing and other forming of the beam of particles. With the invention, a resonator may be used which is operable at a low frequency with low degree of interfering modes. Further the resonator is of reasonably small size and may be readily constructed.

In the testing of an inventive resonator constructed of an aluminum tube of about 0.19 m in diameter and about 0.5 m long with copper rods of about 0.019 m O.D. and about 0.48 m long, it was found that a resonator frequency of about 58 megahertz was developed as the basic frequency. The equation $$\cos^{-1}\left(\frac{2\pi l}{\lambda}\right) = 2\frac{C_{12}}{C_{11}}$$

was used to confirm that the resonant frequency agreed with the calculation value within a few percent and the quadrupole mode was present. The closest interfering mode was in the order of about 110 megahertz.

The embodiments of the invention in which an exclusive property or privilege is claimed are defined as follows:

1. An RFQ resonator for a linear accelerator comprising a cylinder member with a longitudinal axis, an even plurality of modulating, elongated resonating members extending in an axial direction, supported in the cylinder and arranged to form an LC resonant circuit with the inductance being formed along the length of the resonating members to provide a low resonant frequency useful for accelerating heavy particles in the linear accelerator, the capacitance of the LC circuit being based on the equation $$\cos^{-1}\left(\frac{2\pi l}{\lambda}\right) = \frac{2C_{12}}{C_{11}}$$

where l is the length of the resonator, $\lambda$ is the wavelength of the wave, $C_{12}$ is the capacitance between adjacent members and $C_{11}$ is the capacitance between one member and other members and ground, the adjacent resonating members being alternately shorted or open with respect to one end of said cylinder member and power means connected to the cylinder member for generating a multipole electrical field in the vicinity of said axis and a magnetic field transverse to said axis.

2. The resonator of claim 1 wherein said plurality of members is four with said members being arranged about the axis.

3. The resonator of claim 2 wherein the resonator includes inner surfaces of the cylinder and outer surfaces of the resonating members being constructed of copper.

4. The RFQ resonator of claim 1 including a plurality of resonator sections in an end to end arrangement.

5. The RFQ resonator of claim 4 wherein said plurality of resonating members is four with said members being arranged about said axis, adjacent members being alternately shorted or open electrically within each section with respect to said cylinder.

6. The RFQ resonator of claim 5 wherein said cylinder includes spaced-apart plate members dividing the resonator into said sections.

7. The RFQ resonator of claim 6 wherein said resonating members extend across said plurality of sections.

* * * * *